US005373981A

United States Patent [19]

Sowell

[11] Patent Number: 5,373,981

[45] Date of Patent: Dec. 20, 1994

[54] PIN BAR DOFF KNIFE

[75] Inventor: Lyles H. Sowell, Old Hickory, Tenn.

[73] Assignee: E. I. du Pont de Nemours and Company, Wilmington, Del.

[21] Appl. No.: 10,730

[22] Filed: Jan. 29, 1993

[51] Int. Cl.[5] ..... B26F 3/02

[52] U.S. Cl. ..... 225/93; 225/97

[58] Field of Search ..... 225/2, 3, 93, 96, 97

[56] References Cited

U.S. PATENT DOCUMENTS

| | | | |
|---|---|---|---|
| 3,231,164 | 1/1966 | Seidler | 225/96 |
| 3,369,435 | 2/1968 | Boultinghouse | 225/2 |
| 3,485,706 | 12/1969 | Evans . | |
| 3,526,349 | 9/1970 | Moro | 225/3 |
| 3,536,238 | 10/1970 | Iwama et al. | 225/3 |

*Primary Examiner*—Hien H. Phan

[57] ABSTRACT

An apparatus and method for cleanly and consistently cutting certain nonwoven fabrics, specifically spunlaced fabrics. The apparatus comprises a pin bar doff knife having one or more rows of closely-spaced, pointed, parallel pins attached perpendicularly to a bar. When the pin bar doff knife is tensioned against a spunlaced fabric to be cut, the pins act to disentangle individual fibers making up the fabric. The result is a very clean fabric cut when used on either lightweight or heavyweight spunlaced fabrics. In particular, the pin bar doff knife produces consistent cuts in heavyweight spunlaced fabrics made of polyester fibers and/or aramid fibers having very high fiber stiffness.

5 Claims, 2 Drawing Sheets

PIN BAR DOFF KNIFE

FIELD OF THE INVENTION

The present invention relates to an apparatus and method for cutting various nonwoven fabrics during windup operations. In particular, the present invention relates to a pin bar doff knife for cutting spunlaced fabrics during windup roll doffing.

BACKGROUND OF THE INVENTION

U.S. Pat. No. 3,485,706 (Evans) discloses hydraulically needling fibrous webs to produce textile-like nonwoven fabrics. These fabrics are often referred to as spunlaced fabrics and are commercially available from E. I. du Pont de Nemours & Company under the trademark "SONTARA". The hydraulic needling process calls for imparting high energy water jets (i.e., between about 200 to 3,000 psi) to a fibrous web to entangle the web and produce a spunlaced fabric.

In FIG. 40 of Evans, a continuous commercial process is depicted wherein the spunlaced fabric is subsequently dewatered by one or more squeeze rollers, dried, and ultimately collected on a windup roll. After a predetermined amount of spunlaced fabric is collected on the windup roll, the fabric is doff cut by windup knives so that the roll can be prepared for shipping and handling.

In the past, windup knives have been used for cutting relatively lightweight (i.e., less than 2.0 oz/yd$^2$) polyester or polyester/woodpulp spunlaced fabrics during windup roll doffing. These windup knives typically consist of one or more blades that are tensioned across the fabric in order to cut individual fibers across the width of fabric. Typically, insufficent web tension is developed across the knife blades to produce consistent, clean cuts. The problem becomes even worse when aramid fiber (e.g., "KEVLAR" and "NOMEX" commercially available from E.I. du Pont de Nemours and Company) or heavyweight polyester fiber spunlaced fabrics (i.e., greater than 2.0 oz/yd$^2$) are collected on the windup roll. Experience has demonstrated that windup knives are unable to consistently cut these sorts of spunlaced fabrics during windup roll doffing. In fact, not only are such fabrics difficult to cut, they also tend to accelerate knife blade dulling. This results in potential safety and quality problems since long wound-in tails can occur from ineffective cutting at doff.

Clearly, what is needed is an apparatus and method for cutting various nonwoven fabrics which do not have the deficiencies inherent in prior art. In particular, the apparatus should be able to cleanly and consistently cut both lightweight and heavyweight nonwoven fabrics, in particular spunlaced fabrics, even if the fibers making up those fabrics are relatively stiff in nature (e.g., heavyweight polyester fibers or aramid fibers). Other objects and advantages of the present invention will become apparent to those skilled in the art upon reference to the attached drawings and to the detailed description of the invention which hereinafter follows.

SUMMARY OF THE INVENTION

The invention generally relates to an apparatus and method for cutting nonwoven fabrics whose structural integrity depends on fiber-to-fiber entanglement. In particular, the invention relates to a pin bar doff knife for cutting spunlaced fabrics during windup operations. Fabric cutting takes place by disentangling individual fibers of the fabric and causing the fabric to be torn apart in the area of contact with the pins of the pin bar doff knife.

In one embodiment, the invention comprises a bar having a plurality of short, closely-spaced, parallel pins which are present across the bar in one or more rows. The pins are attached perpendicularly across the bar. The pins are tapered so they terminate in pointed tips and can be arranged in a variety of arrangements and heights.

In use, the inventive pin bar doff knife produces consistent, clean cuts in certain nonwoven fabric sheets by providing pins that disentangle fabric fibers rather than actually cutting individual fibers. The cutting mechanism is actually a controlled tear in which the individual fibers are distentangled from one another by the web tension pulling against the pins. A "cut" produced by the pins requires only that web strength due to fiber entanglement be overcome and not the shear strength of the fibers themselves. Since this is the case, pin diameter is not an important factor in producing clean consistent cuts.

The substitution of a pin bar doff knife according to the invention for prior art cutting devices (e.g., windup knives) produces clean, consistent cuts in both lightweight and heavyweight fabrics made from a wide variety of fibers (e.g., polyester, polyester/woodpulp, acrylic and aramid fibers).

BRIEF DESCRIPTION OF THE DRAWINGS

The invention will be better understood with reference to the following figures.

DETAILED DESCRIPTION OF THE PREFERRED EMBODIMENTS

Figure 1:
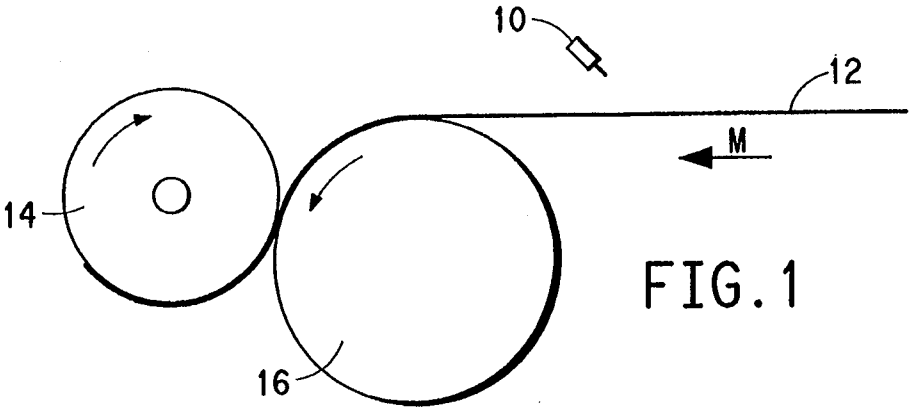
FIG. 1 is a schematic view showing the arrangement of a pin bar doff knife in relation to the moving fabric and the windup roll.

Although the invention is particularly useful for cutting spunlaced fabrics, it will be understood that it may also be used for cutting nonwoven fabrics whose structural integrity depends on fiber-to-fiber entanglement (e.g., certain lightly bonded nonwoven fabrics). These fabrics have individual fibers which are capable of being disentangled by the penetration of the pins of the pin bar doff knife when forced into the fabric.

As used herein, the term "closely-spaced" means that the distance between pointed tips of parallel pins of the pin bar doff knife is no more than about $\frac{3}{8}$ inches. Preferably, the pointed tips of the pins are spaced between about $\frac{1}{8}$ to $\frac{1}{4}$ inches apart when attached to the bar. If the pointed tips of the pins are greater than about $\frac{3}{8}$ inches apart across the length of the bar, the pin bar doff knife will not cleanly cut the nonwoven fabric. Spacing is preferably uniform between adjacent pin tips, although this is not critical to the invention.

In order to most easily describe the invention, the following non-limiting examples are provided to show its particular applicability to spunlaced fabrics.

A specific example of a spunlaced fabric that may be cut according to the applicant's invention may be prepared according to the teachings of U.S. Pat. No. 3,485,706 (Evans), the entire contents of which are incorporated herein by reference. Preferably, the web is formed of staple fibers that have been carded or air-laid and supported on a screen (e.g., a 75 mesh screen). The staple fibers are typically polyester but they may also be aramids (e.g., "KEVLAR" and/or "NOMEX") or mixtures of both. Acrylic or woodpulp fibers may also be blended into the aforementioned staple fibers depending on the end-use desired.

The supported staple fibers are then passed under a series of high pressure water jets (preferably from 200 to 3,000 psi jet pressure) such that the staple fibers are hydraulically needled into a spunlaced fabric. Following hydraulic needling, the fibers become entangled in a three dimensional state. Methods and equipment suitable for hydraulically needling such fibers are disclosed in more detail in the Evans patent and in U.S. Pat. No. 3,403,862 (Dworjanyn). Typically, after the composite web structure is hydraulically needled into a spunlaced nonwoven fabric excess water is removed by vacuum dewatering and/or by squeeze rolling. Drying is then performed at a temperature which doesn't cause thermal bonding (i.e., fusing) of the spunlaced fabric to take place.

Following drying, the spunlaced fabric is collected on a windup roll until it is doffed. At that point, the plurality of pointed, closely-spaced, parallel pins are tensioned against the spunlaced fabric such that the pins contact and penetrate the fabric. This causes the fabric fibers to disentangle such that the structural integrity and web strength of the fabric are reduced in the area of pin penetration. However, pin penetration does not cause individual fabric fibers to be cut. As individual fabric fibers are disentangled, the fabric begins to tear apart in the area of pin penetration thereby forming a clean fabric cut. Experience has demonstrated that in order to produce clean, consistent fabric cuts, the pins of the pin bar doff knife must be tensioned against the fabric with only enough force that they overcome fabric strength due to fiber entanglement.

Preferably, the pins should be sharply pointed (i.e., terminate in tips) to facilitate pin entry into the fabric when tension is applied. A blunt pin tip or a constant diameter pin will not sufficiently work to produce clean fabric cuts.

Preferably, the bar is fabricated of stainless steel (e.g., Type 304 or 316), although this is not critical to the invention. One may also use any material which would form a rigid bar (e.g., steel, aluminum, brass or plastic).

Preferably, the pins are fabricated of a heat treatable stainless steel such as Type 420, although this is not critical to the invention. As an alternative, the pins may be fabricated of a carbon steel material.

Pin height (i.e., the distance of the pins from base to tip) is not critical, although heights of between about 0.3 to 1.0 inch are generally preferred.

Referring now to the drawings, FIG. 1 shows a pin bar doff knife 10 in relation to a spunlaced fabric 12 moving in direction M and a windup roll 14. The pin bar doff knife is angled such that the pointed tips of the pins easily penetrate the fabric when they are forced against the fabric. The windup roll 14 is driven by windup drive roll 16. In use, the pin bar doff knife 10 is tensioned against the moving fabric by tensioning means (not shown) in order to cleanly cut the fabric. After the fabric is cut, the windup roll is removed and prepared for storage or shipping.

Figure 2:
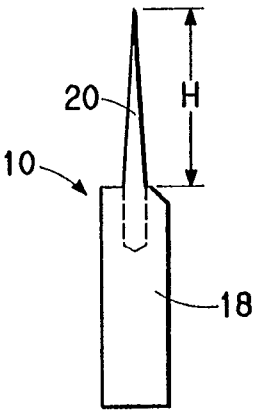
FIG. 2 is a side view of a pin bar doff knife in accordance with the invention having a single row of short, closely-spaced, parallel pins all of equal height H.

FIG. 2 is a side view of a pin bar doff knife 10 having a rigid bar 18 and a single row of pointed, closely-spaced, parallel pins 20 which are perpendicularly attached to the bar. In this view only one pin can be seen. The pins have a height H (e.g., $\frac{3}{4}$ inch) measured from pin base to the pin tip.

Figure 3:
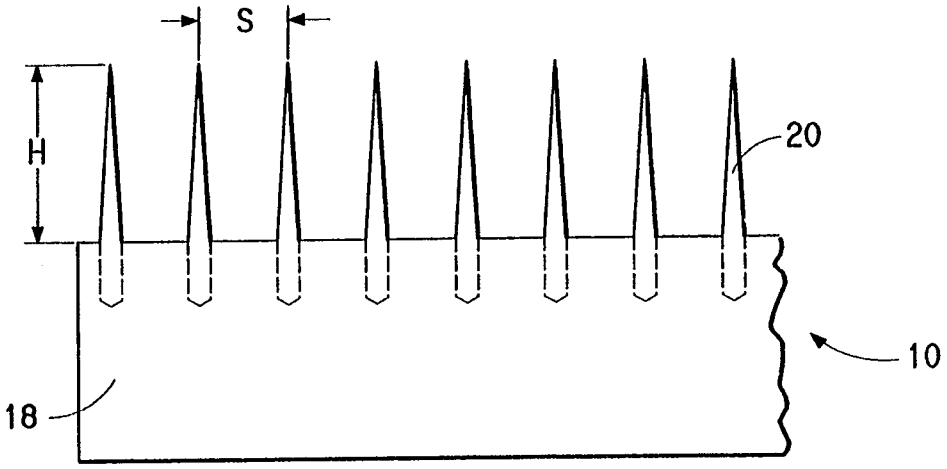
FIG. 3 is a cross-sectional view of the pin bar doff knife of FIG. 2 showing the row of pins with equal spacing S.

FIG. 3 is a cross-sectional view of the pin bar doff knife of FIG. 2 showing the pointed, closely-spaced, parallel pins 20 attached to the bar 18. The pins have a uniform height of H (e.g., $\frac{3}{4}$ inch) and a uniform spacing S (e.g., $\frac{3}{8}$ inch) across the entire length of the single pin row.

Figure 4:
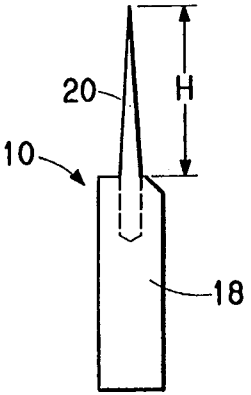
FIG. 4 is a side view of a pin bar doff knife in accordance with the invention having a single row of short, very closely-spaced, parallel pins all of equal height H.

FIG. 4 is a side view of a pin bar doff knife 10 having a rigid bar 18 and a single row of pointed, very closely-spaced, parallel pins 20 which are perpendicularly attached to the bar. In this view only one pin can be seen. The pins have a height H (e.g., $\frac{3}{4}$ inch) measured from pin base to the pin tip.

Figure 5:
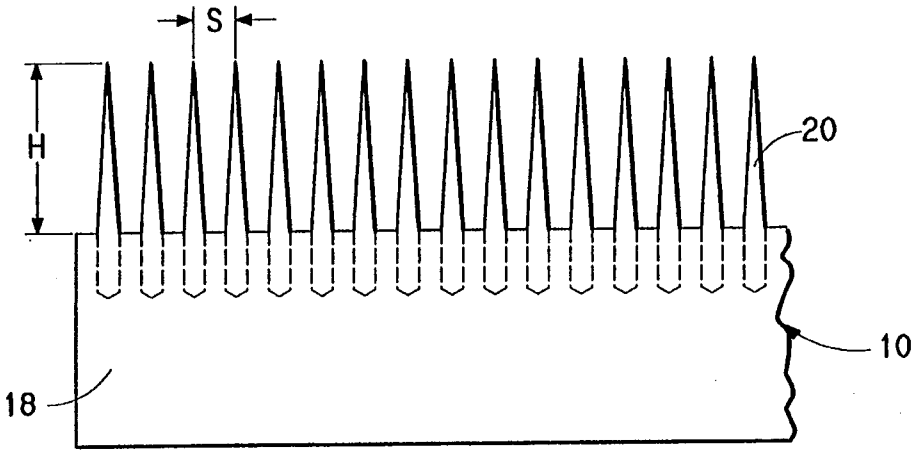
FIG. 5 is a cross-sectional view of the pin bar doff knife of FIG. 4 showing the row of pins with equal spacing S.

FIG. 5 is a cross-sectional view of the pin bar doff knife of FIG. 4 showing the pointed, very closely-spaced, parallel pins 20 attached to the bar 18. The pins have a uniform height of H (e.g., $\frac{3}{4}$ inch) and a uniform tight spacing S (e.g., 3/16 inch) across the entire length of the single pin row. The tighter spacing tends to produce a smoother fabric cut than if a wider spacing is used (see FIG. 3).

Figure 6:
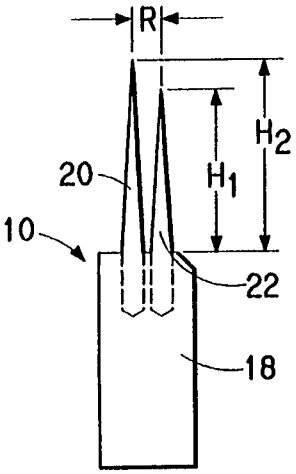
FIG. 6 is a side view of a pin bar doff knife in accordance with the invention having a double row of short, closely-spaced, parallel pins; the pins of row i of height $H_1$ and the pins of row 2 of height $H_2$.

FIG. 6 is a side view of a pin bar doff knife 10 having a rigid bar 18 and a double row of pointed, closely-spaced, parallel pins 20 and 22 which are perpendicularly attached to the bar. In this view only two pins can be seen. The rows are spaced a distance R (e.g., $\frac{1}{8}$ inch) apart as measured from pin tip to pin tip. The pins of row 1 have a height $H_1$ (e.g., $\frac{5}{8}$ inch) measured from pin base to the pin tip. The pins of row 2 have a height $H_2$ (e.g., $\frac{3}{4}$ inch) measured from pin base to pin tip.

Figure 7:
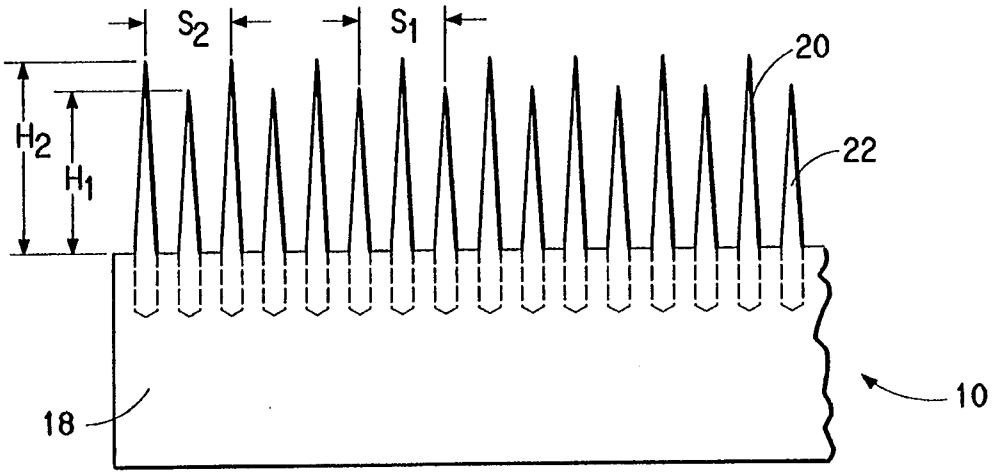
FIG. 7 is a cross-sectional view of the pin bar doff knife of FIG. 6 showing the double row of pins in more detail. The pins of row 1 are positioned midway between adjacent pins of row 2 and spaced a distance of $S_1$ apart while the pins of row 2 are spaced a distance of $S_2$ apart.

FIG. 7 is a cross-sectional view of the pin bar doff knife of FIG. 6 showing the double row of pointed, closely-spaced, parallel pins 20 and 22 attached to the bar 18. The pins 22 of row 1 have a uniform height of $H_1$ (e.g., $\frac{5}{8}$ inch) and a uniform spacing $S_1$ (e.g., $\frac{3}{8}$ inch) across the entire length of row 1. The pins 20 of row 2 have a uniform height of $H_2$ (e.g., $\frac{3}{4}$ inch) and a uniform spacing $S_2$ (e.g., $\frac{3}{8}$ inch) across the entire length of row 2. Having two rows of pins of different heights tends to ease the entry of the pins into the fabric when tension is applied by reducing the number of pins entering the sheet at one instant in time. By staggering the spacing of row 1 and row 2, the pin-to-pin spacing is also reduced from the perspective of the fabric.

When various embodiments of the invention are used, polyester spunlaced fabrics of from 1.2 to 4.0 oz/yd$^2$ can routinely be cut. Also aramid spunlaced fabrics of various basis weights can be successfully cut.

In contrast to past experiences with knife blades, where the cutting effort increases drastically with basis weight, the cutting effort for a pin bar doff knife does not drastically increase with basis weight. A comparasion of Instron data (see Tables A, B and C below) indicates that with a pin bar doff knife, the energy required to cut the fabric is roughly proportional to the basis weight of the fabric. Also, tests on the three above-described embodiments (i.e., FIGS. 3, 5 and 7) confirm that for fabrics of equal weight, an aramid fiber blend product requires equal, or only slightly more, energy to cut than does a polyester spunlaced fabric.

TABLE A

| Style No. | Basis Weight (oz/yd$^2$) | FIG. 3 Embodiment Load (lbs) | Strain (%) | Energy (lbs-in) |
|---|---|---|---|---|
| Polyester | | | | |
| 8002 | 1.3 | 25.84 | 31.49 | 22.35 |
| 8005 | 2.0 | 36.61 | 31.05 | 36.24 |
| 8007 | 3.2 | 60.22 | 27.24 | 45.85 |
| 8100 | 4.0 | 85.74 | 35.59 | 83.96 |
| Aramids | | | | |
| 8312 ("NOMEX") | 1.2 | 25.19 | 34.13 | 24.14 |
| Z11 ("KEVLAR) | 2.2 | 38.53 | 19.92 | 22.40 |
| 8515 ("NOMEX"/ "KEVLAR") | 3.2 | 66.85 | 28.71 | 56.65 |
| 390 ("NOMEX") | 9.0 | 122.40 | 28.56 | 138.70 |

TABLE B

| Style No. | Basis Weight (oz/yd$^2$) | FIG. 5 Embodiment Load (lbs) | Strain (%) | Energy (lbs-in) |
|---|---|---|---|---|
| Polyester | | | | |
| 8002 | 1.3 | 32.97 | 30.76 | 21.98 |
| 8005 | 2.0 | 48.41 | 30.61 | 31.30 |
| 8007 | 3.2 | 77.77 | 25.49 | 43.08 |
| 8100 | 4.0 | 114.10 | 35.88 | 83.36 |
| Aramids | | | | |
| 8312 ("NOMEX") | 1.2 | 36.01 | 36.62 | 25.10 |
| Z11 ("KEVLAR") | 2.2 | 45.18 | 21.82 | 31.91 |
| 8515 ("NOMEX"/ "KEVLAR") | 3.2 | 90.35 | 30.61 | 58.90 |
| 390 ("NOMEX") | 9.0 | 190.00 | 32.96 | 158.20 |

TABLE C

| Style No. | Basis Weight (oz/yd$^2$) | FIG. 7 Embodiment Load (lbs) | Strain (%) | Energy (lbs-in) |
|---|---|---|---|---|
| Polyester | | | | |
| 8002 | 1.3 | 31.86 | 34.42 | 22.93 |
| 8005 | 2.0 | 48.97 | 33.83 | 35.64 |
| 8007 | 3.2 | 82.26 | 29.00 | 53.33 |
| 8100 | 4.0 | 113.60 | 37.06 | 87.77 |
| Aramids | | | | |
| 8312 ("NOMEX") | 1.2 | 33.22 | 36.62 | 25.91 |
| Z11 ("KEVLAR") | 2.2 | 47.52 | 22.58 | 34.52 |
| 8515 ("NOMEX"/ "KEVLAR") | 3.2 | 86.68 | 30.61 | 61.82 |
| 390 ("NOMEX") | 9.0 | 176.40 | 35.52 | 154.60 |

In the tables, all pins were 0.078 inches in diameter. Also, all Style Numbers are for commercial "SONTARA" spunlaced fabrics commercially available from E. I. du Pont de Nemours and Company, Wilmington, Del.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

I claim:

1. An apparatus for use in cutting nonwoven fabrics whose structural integrity depends on fiber-to-fiber entanglement, comprising:
   (a) a bar having at least two rows of closely-spaced, parallel pins attached thereto, the pins being tapered such that they terminate in pointed tips; and
   (b) tensioning means for forcing the pins against and into the nonwoven fabric to be cut, the pins capable of disentangling, but not cutting, individual fibers of the fabric when in contact with the fabric.

2. The apparatus of claim 1 wherein the bar and pins are fabricated of stainless steel.

3. The apparatus of claim 1 wherein the pins are spaced between about $\frac{1}{8}$ to $\frac{1}{4}$ inches apart from each other across the bar.

4. The apparatus of claim 1 wherein the pins extend from the bar a distance of between 0.3 to 1.0 inches.

5. An apparatus of claim 1 wherein the nonwoven fabric is a spunlaced fabric.

* * * * *